US006062280A

United States Patent [19]

Newnes et al.

[11] Patent Number: 6,062,280

[45] Date of Patent: May 16, 2000

[54] METHOD AND APPARATUS FOR SCANNING, OPTIMIZING AND EDGING A BOARD WITH AND AN ACTIVE EDGER

[75] Inventors: William R. Newnes; Steven W. Michell; Brian T. Stroud, all of Salmon Arm, Canada

[73] Assignee: CAE Electronics Ltd. CAE Electronique Ltee, St. Laurent, Canada

[21] Appl. No.: 09/158,836

[22] Filed: Sep. 23, 1998

Related U.S. Application Data

[60] Provisional application No. 60/060,057, Sep. 25, 1997.

[30] Foreign Application Priority Data

Sep. 24, 1997 [CA] Canada ..... 2215582

[51] Int. Cl.[7] ..... B27B 1/00; B27B 31/00

[52] U.S. Cl. ..... 144/357; 83/368; 83/370; 83/425.3; 83/425.4; 144/3.1; 144/39; 144/245.1; 144/246.1; 144/248.4; 144/250.14; 144/378; 144/382

[58] Field of Search ..... 83/365, 368, 370, 83/371, 425.2, 425.3, 425.4, 404.1, 409, 820, 821; 144/2.1, 3.1, 39, 41, 357, 376–378, 382, 246.1, 245.1, 248.4, 250.14, 250.17

[56] References Cited

U.S. PATENT DOCUMENTS 4,239,072 12/1980 Meriläinen .
4,449,557 5/1984 Mäkelä et al. ..... 144/357
4,599,929 7/1986 Dutina ..... 83/821
5,429,161 7/1995 Allard ..... 144/246.1
5,816,302 10/1998 Newnes ..... 144/357
5,853,038 12/1998 Newnes ..... 144/357
5,884,682 3/1999 Kennedy et al. ..... 144/357

*Primary Examiner*—W. Donald Bray
*Attorney, Agent, or Firm*—Antony C. Edwards

[57] ABSTRACT

An active edger includes an actively positionable gangsaw or a first end saw mounted on an arbor mounted within a stationary saw box. The gangsaw or first end saw is actively positionable relative to the saw box. In a second embodiment, the gangsaw or first end saw is mounted on an arbor in fixed translational and skewing relation relative to, and within, an actively positionable saw box. The actively positionable gangsaw is selectively actively laterally translatable and selectively actively rotatable so as to skew the gangsaw relative to the saw box. In both embodiments, the saw box receives a workpiece, longitudinally conveyed in a downstream direction, longitudinally into the gangsaw or first end saw from an upstream position. A first chipping head, mounted to a first side of the saw box adjacent and downstream of the first end saw or a first end saw in the gangsaw is, in the first embodiment, selectively actively laterally positionable so as to align with a first feed line corresponding to the first end saw in unison with active positioning of the gangsaw, relative to the workpiece. In both embodiments, the first chipping head actively corresponds, in a lateral chipping depth, to a lateral edging dimension of a sawn edging sawn from the workpiece. The sawn edging is chipped as the workpiece is conveyed from, once sawn by, the gangsaw, longitudinally past the first chipping head.

37 Claims, 12 Drawing Sheets

METHOD AND APPARATUS FOR SCANNING, OPTIMIZING AND EDGING A BOARD WITH AND AN ACTIVE EDGER

CROSS REFERENCE TO RELATED APPLICATION

This application claims priority from Canadian Patent Application No. 2,216,582 filed Sep. 27, 1997 and U.S. Provisional Patent Application No. 60/060,057 filed Sep. 25, 1997 both entitled Method And Apparatus For Scanning, Optimizing And Edging A Board With An Active Edger.

FIELD OF THE INVENTION

This invention relates to a method and an apparatus for lineal or horizontal scanning and edging of boards or flitches including skewed flitches, for lumber, and in particular relates to a board edging system, for the edging (rip sawing) of a board according to an optimized profile in an active edger having with saws and chippers so as to eliminate a tailing device.

BACKGROUND OF THE INVENTION

A board, or "flitch", by definition has first and second opposed cut planar faces and first and second opposed waned edges. In the prior art, flitches would be scanned and sequenced horizontally, positioned in the desired skew, if any, and then clamped by feed rolls to be feed linearly into a conventional edger. Alternatively, the flitches would be symmetrically centered in the direction of flow, fed through a linear scanner, and then, in the same direction of flow, into an edger capable of skewing and laterally translating. The first approach is effective, but the system is quite expensive and the positioning of the flitch can take up time. The second approach, such as is taught in U.S. Pat. No. 4,599,929 to Dutina, works fine, but the system does not take full advantage of modern automatic controls and does not teach the requisite mechanics to do so.

Different lineal scanning and positioning methods have been used. U.S. Pat. No. 4,239,072, to Meriläinen, discloses a lineal scanning and skew edging process, but does not allow for multiple saws. U.S. Pat. No. 4,449,557, to Mäkelä, discloses a similar process to that of Meriläinen '072, but lacks the ability to reduce the edgings to chips, and also does not allow for multiple saws.

U.S. Pat. No. 5,429,161 to Allard discloses a linear scanning resawing process. The apparatus positions the workpiece while the workpiece is moving by means of two pair of tandem, opposed top and bottom, clamp rollers that skew the workpiece as it is translated for resawing. This process relies on twisting the workpiece as it moves through the roller clamps. This causes skidding of the workpiece between the rollers as they are skewed. The variance in friction between different workpieces and the rollers and the difference in the direction of the rollers' axis and the direction of the workpiece as it travels through the roller clamps, may cause a margin of error that reduces the recovery percentage. It is well known in the industry that roll feed edgers are not that accurate.

SUMMARY OF THE INVENTION

The method and apparatus for scanning, optimizing and edging a board with an active edger, and control thereof, consists of, first, an unscrambler that receives and separates the flitches from the mill. The unscrambler feeds the flitches onto an even ending roll case having a live fence. The ending rolls even-end the flitches against the live fence, and then transfer the flitches to a flitch sequencing transfer table, or, for timed release, on to a variable speed lugged transfer table. The transfer table gathers and advances the flitches. The profiles of the flitches are scanned at this point if using a transverse scanning system. The flitches are advanced for timed release, so as to queue the flitches for release onto a chain feed, or other type of feed table, where the flitches are roughly positioned to "zero far side" against a fence (also known as a line bar). The flitches are advanced, perpendicular to the flow of the transfer table, straight towards the active edger. The feed table feeds the flitches singly on to a wide circulating belt, or belt conveyor, separated only by the distance needed to queue up the next fitch on to the roll case. When using a lineal scanner, the belt conveyor moves the flitches through the lineal scanner where the scanner reads the profiles of the flitches and sends the data to a decision processor system.

The advantage of "zero far side" positioning is to allow for the simplest possible positioning of a fitch on the feed table for feeding to the edger. This also allows the corresponding edger far side saw and/or chip head to remain in a localized area while the opposite edger saw(s) and chip head are adjusted to obtain the desired board width(s). This reduces the tailing solution needed behind the edger, thus reducing the complexity of the tailer and the time needed to make the adjustments of the tailer.

In the decision processor an optimizing algorithm generates a three dimensional model from the Hitch's measurements and calculates the optimized edging solution. Data is then transmitted to a programmable logic controller (PLC) that in turn sends motion control information related to the optimum breakdown solution to the active edger, which sets the start position and controls the movement of the saws and chip heads using a motion controller, which may be position based.

The fitch moves from the scanner, along the belt conveyor, to a sharpchain positioned just in front of the active edger. Overhead driven press rolls above the sharpchain press the fitch down against the top of the sharpchain as the fitch feeds straight into the active edger. The overhead pressrolls cooperate with the circulating sharpchain in the infeed area of the active edger to control the direction and accuracy of straight feeding. The active edger feed area may also have split bedrolls in the infeed area. Non-split bedrolls may be provided in the outfeed area, also having overhead pressrolls. The flitch is pressed down by the overhead pressrolls onto the lower infeed sharpchain and bedrolls as the flitch is fed straight into and through the edger saws and chip heads. The saws and chip heads actively follow the optimum path unique to the flitch, the saws reducing the flitch to boards, the chip heads reducing the edgings to chips.

The sawing device rotates the guides and saws on an axis perpendicular to the flow, and simultaneously translates the guides and saws transversely to the flow to accomplish active cutting of a workpiece. The chip heads clean up the edgings.

The efficiency of lumber production from flitches, and in particular for irregular or crooked flitches, is improved by placing the flitch against a fence to the "zero far side" of a conveyor. The conveyor then moves the flitch through a lineal scanner, if not already scanned on a transverse scanner. The flitch is moved straight in the direction of flow through the edger, where the saws and chip heads skew and actively translate in unison to saw and chip the flitch. Conical chip heads can be mounted with a toe-in equal to the maximum skew of any given flitch, which allows the chip heads to remain substantially perpendicular to the direction of flow as the chip heads translate perpendicular to the flow along with the saws, which must skew and translate to cut the skewed flitch as desired. By attaching chip heads immediately behind the saws and in the saw feed line, and translating the chip heads along with the saws, the need to handle the edgings after they exit the edger is eliminated.

The efficiency of lumber production from flitches, and in particular for irregular or crooked flitches, is also improved by employing position-based motion controls for use with the active edger, which motion controls follow the cutting solution for each flitch as determined by both the optimizer from the scanned profile of the flitch and the desired lumber prerequisites. The teaching of applicant's co-pending U.S. patent application Ser. No. 08/822,947, filed Mar. 21, 1997, entitled Position-Based Integrated Motion Controlled Curve Sawing, is hereby incorporated by reference.

Controlling the saws through the guides, as set out in more detail below, by cutting a gentle curve along the profile of a given flitch, in certain situations and given sawmill requisites, allows for increased board length and thus increased recovery percentage. This is achieved by accurate control of the saws by means of the saw guiding system described below and the position based motion controls working in cooperation with the optimizer which can be programmed to recognize a situation where a gentle curve may improve recovery percentage.

By the edger saws skewing and translating, and the edger chip heads translating in unison with the saws, so as to traverse the skew of the flitch as the flitch moves through the edger, the flitch only moves through the edger straight, in the direction it was scanned. The edger saws and chip heads adjust for width and skew for starting position, and then translate together actively, to traverse the flitch by translating the saws and chip heads as the flitch moves through the edger so as to cut along the optimized path that has been determined by the optimizer.

An infeed anvil may be positioned tightly adjacent the bottom of the chip head(s). The anvil directs the edgings into the chip head(s) and prevents the edgings from being deflected down by the chip head(s) rotational cutting forces. The chip head(s) may be conical or drum-like, and may have compound angled knives that slice rather than chop the edgings, thus producing better quality chips. The infeed anvil and the chip heads may be positioned in the saw feed line and close to the rear, that is, the downstream end of the saw blades, and may be attached to the same positioner cylinders for simultaneous translation of the chip heads and the saws. Outfeed vertical faced anvils may also be placed behind the chip heads to counteract any forces that the opposing chip head may cause. An opposing roller may be provided, cushioned and adjustable, so as to inhibit the zero far side chip head forces from pushing the flitch off the feed line, when using only one chip head on the far side.

In an alternate chipper disc configuration, V-shaped wing knives are provided which prevent edging slivers from being forced between the chipping disc and the board.

The chip heads are used to reduce the edgings of the flitch so that there is no need to handle the edgings behind the edger.

In summary, and not so as to exclude the above, the active edger in a first embodiment of the present invention includes an actively positionable gangsaw or a first end saw mounted on an arbor mounted within a stationary saw box, wherein the gangsaw or first end saw is actively positionable relative to the saw box. In a second embodiment, the gangsaw or first end saw is mounted on an arbor in fixed translational and skewing relation relative to, and within, an actively positionable saw box. The actively positionable gangsaw is selectively actively laterally translatable and selectively actively rotatable so as to skew the gangsaw relative to the saw box. In both embodiments, the saw box receives a workpiece, longitudinally conveyed in a downstream direction, longitudinally into the gangsaw or first end saw from an upstream position. A first chipping head, mounted to a first side of the saw box adjacent and downstream of the first end saw or a first end saw in the gangsaw is, in the first embodiment, selectively actively laterally positionable so as to align with a first feed line corresponding to the first end saw in unison with active positioning of the gangsaw, relative to the workpiece. In both embodiments, the first chipping head actively corresponds, in a lateral chipping depth, to a lateral edging dimension of a sawn edging sawn from the workpiece. The sawn edging is chipped as the workpiece is conveyed from, once sawn by, the gangsaw, longitudinally past the first chipping head.

In one aspect of the present invention, the active edger further comprises a second actively laterally positionable chipping head mounted to a second side of the saw box, where the second side is opposite to the first side of the saw box. The second chipping head may be downstream of a second end saw mounted on the arbor in the saw box, and actively laterally positionable so as to actively align with a second feed line corresponding to the second end saw, and so as to actively laterally position in unison with the second end saw. The second chipping head may be adjacent the second end saw and mounted in generally opposed facing relation to the first chipping head, or may be staggered, relative to the first chipping head, in a downstream direction. Advantageously, in the first embodiment, the first and second chipping heads are aligned with toe-in relative to the alignment of the first and second end saws.

In a further aspect of the invention the saws are positioned by positioning saw guides corresponding to saws on the gangsaw. The saw guides are selectively rotatable about corresponding generally vertical axes of rotation whereby rotating the guides skews the saws. The guides are positioned by selectively rotatable generally vertical shafts corresponding to the guides, and rigidly mounted thereto. Selective rotation means selectively rotate the shafts about their longitudinal axes to thereby rotate the guides and the saws. The selective rotation means may be actuator driven worms and mating worm gears for selective rotation of the shafts.

The active edger of the present invention advantageously further includes means for cantilevering the workpiece over a gap in a workpiece conveyor. The gap is downstream of the active edger. The cantilever means is a means for cantilevered supporting of the workpiece, but not the sawn edging, whereby the sawn edging may fall into the gap as the workpiece is conveyed over the gap by the workpiece conveyor.

The invention provides other advantages which will be made clear in the description of the preferred embodiments.

BRIEF DESCRIPTION OF THE DRAWINGS

The invention will be better understood by reference to drawings, wherein.

DETAILED DESCRIPTION OF PREFERRED EMBODIMENTS

Figure 1:
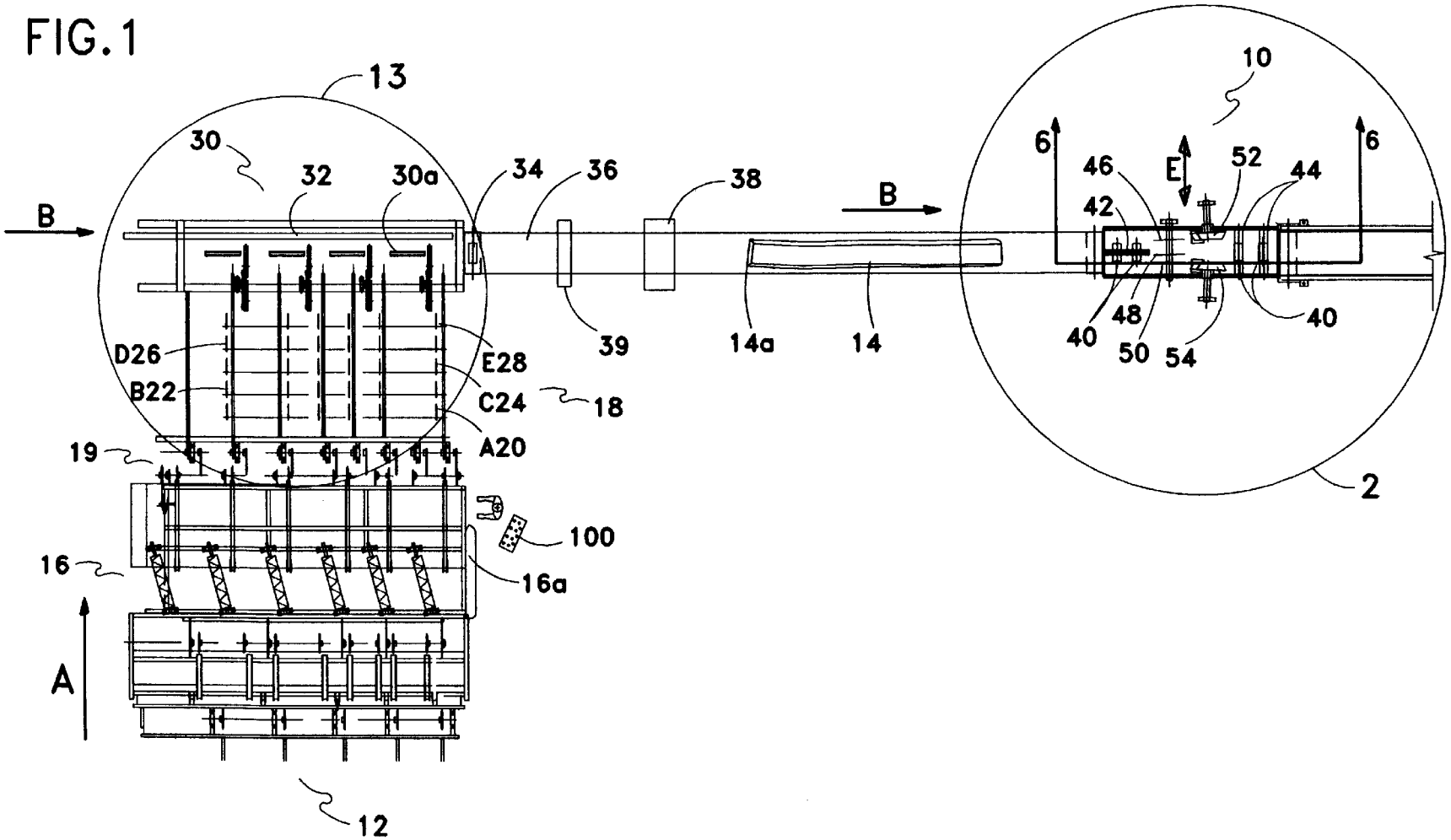
FIG. 1 is a plan view according to a preferred embodiment of the invention.
Figure 2:
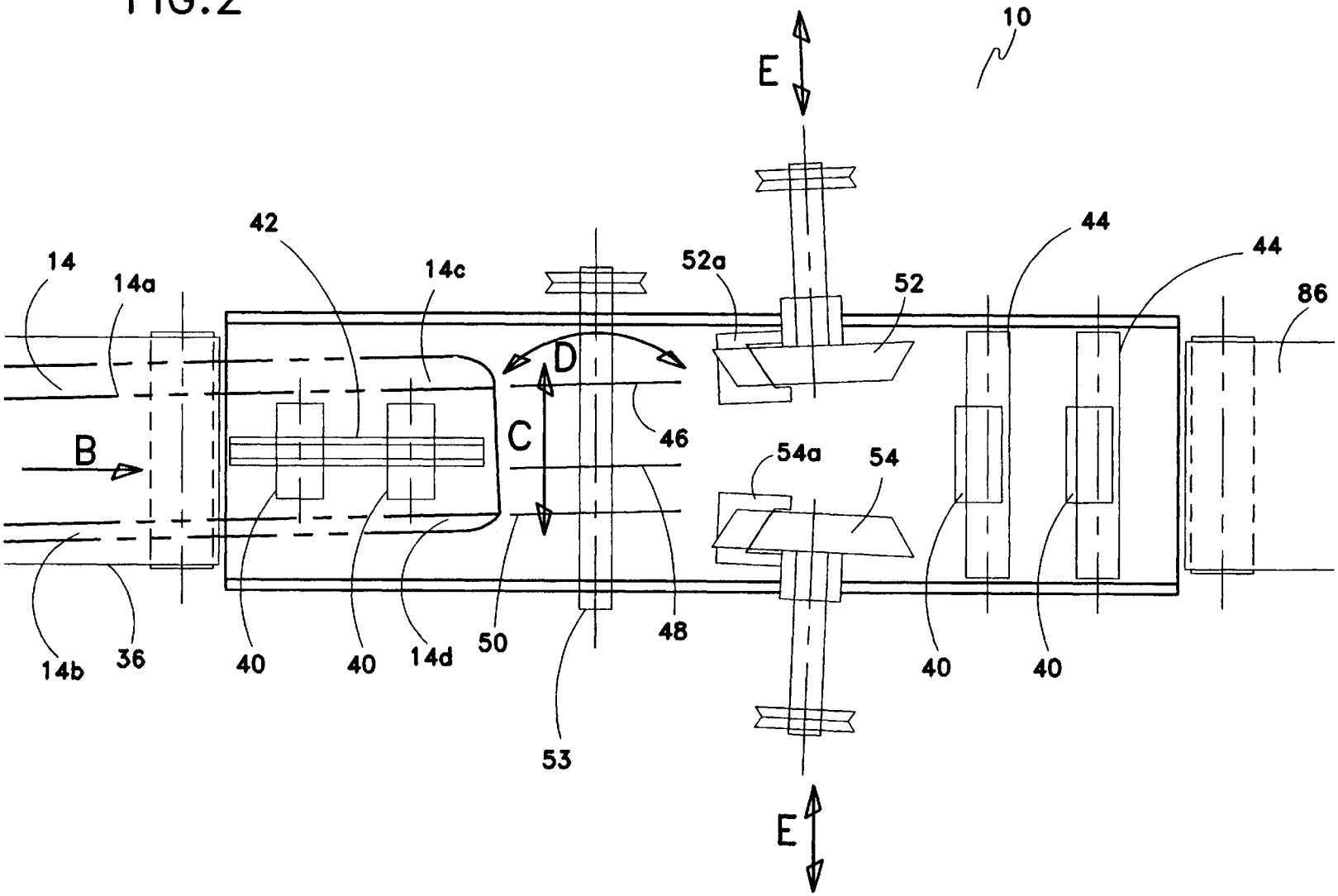
FIG. 2 is an enlarged plan view according to the preferred embodiment of FIG. 1.
Figure 6:
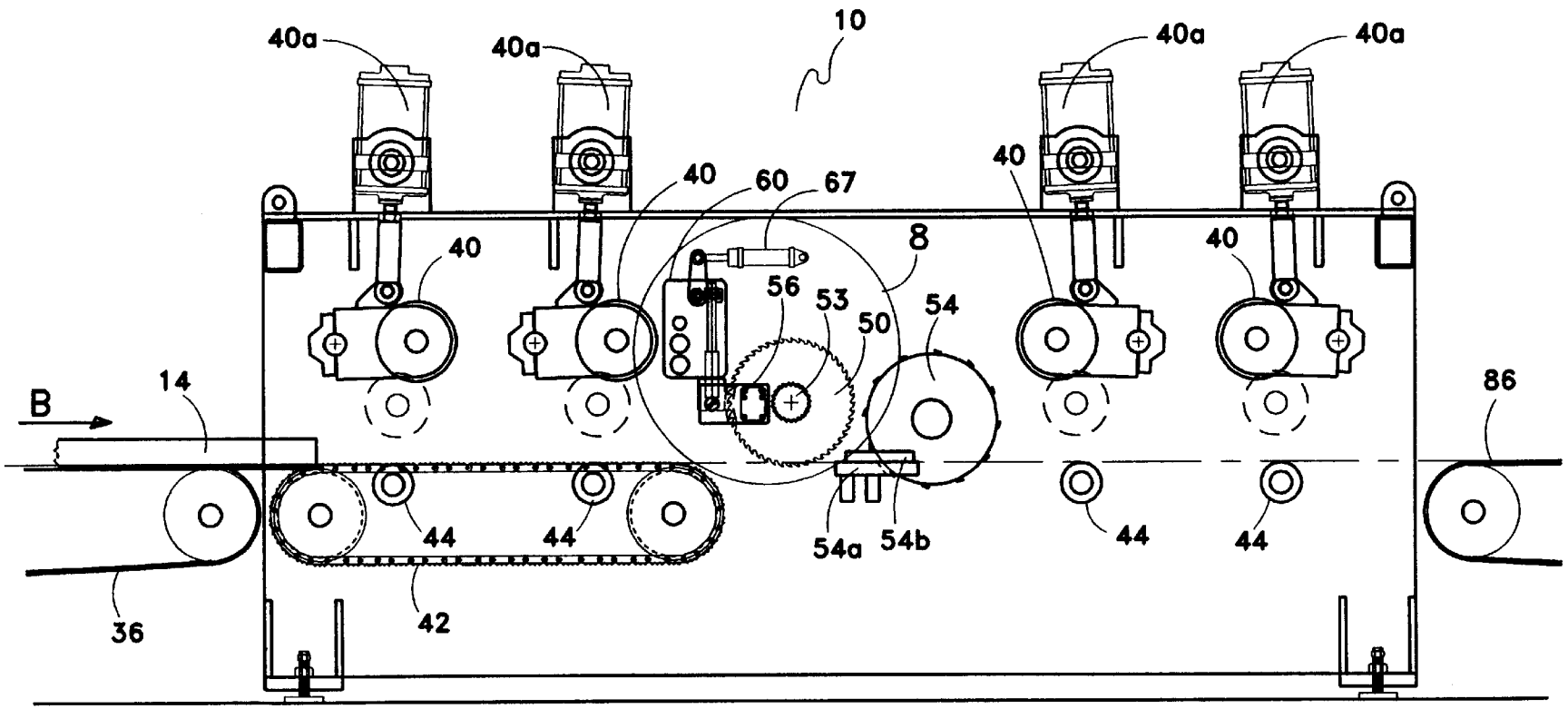
FIG. 6 is an elevation view according to the preferred embodiment of the invention, taken along section line 6—6 in FIG. 1.

Referring to the drawing figures wherein similar characters of reference represent corresponding parts in each view, one preferred embodiment of the active edger apparatus is generally indicated by the reference numeral 10 and is best seen in FIGS. 1, 2 and 6.

As illustrated in FIG. 1, unscrambler 12 receives flitches 14 from the mill in direction A. Flitches 14 are separated by unscrambler 12 and then fed onto an even ending roll case 16 which ends the flitches onto live fence 16*a*. Flitches 14 are then transferred on to a flitch transfer table 18, or a dropout 19. Dropout 19 allows the operator to reject a fitch before it moves on to transfer table 18. Transfer table 18 advances flitches 14 to ducker A20. When ducker B22 on transfer table 18 becomes available, fitch 14 is sequenced from ducker A20 to ducker B22. When ducker C24 on transfer table 18 becomes available, fitch 14 is sequenced from ducker B22 to ducker C24. When ducker D26 on transfer table 18 becomes available, fitch 14 is sequenced from ducker C24 to ducker D26. When ducker E28 on transfer table 18 becomes available, fitch 14 is sequenced from ducker D26 to ducker E28.

In an alternative embodiment, a variable speed lugged transfer table with lugged transfer chains (not shown) may also be employed. Timing skids (not shown), mounted near dropout 19, would hold back the flow of flitches 14 for timed release on to the lugged transfer table.

Feed table 30 receives flitches 14, one at a time, from ducker E28. Feed table 30 moves flitch 14 against fence 32. Once flitch 14 contacts fence 32, feed table 30 begins to translate flitch 14 in direction B. Flitch 14 moves from feed table 30 and fence 32, onto a wide circulating belt 36, which continues to translate flitch 14 in direction B. A driven overhead press roll 34, mounted near the upstream end of belt 36, assist in accelerating flitch 14 on to belt 36. Flitch 14 translates on belt 36 through lineal profile scanner 38. Lineal profile scanner 38 obtains an image of flitch 14.

In an alternative embodiment an x-ray grade scanner 39 may be mounted adjacent, that is, in opposed relation above and below belt 36, upstream or downstream of lineal profile scanner 38. This X-ray grade scanner 39 may be of the type described in U.S. Pat. No. 4,879,752 to Jan Aune. The incorporation of X-ray grade scanner 39 in this manner may provide better optimization of the breakdown of flitch 14.

As best seen in FIGS. 2 and 6, a plurality of driven pressrolls 40, each actuated by pressroll cylinders 40*a*, receive flitch 14 prior to flitch 14 entering active edger 10. Pressrolls 40 press down to hold flitch 14 against the sharpchain 42, and onto split bedrolls 44 if so provided. Driven pressrolls 40 and sharpchain 42 drive flitch 14 in a straight line in direction B into active edger 10. Saws 46, 48 and 50, and chip heads 52 and 54 translate in direction E as flitch 14 moves through edger 10. Chip heads 52 and 54 are shown with toe-in of approximately 2.5 degrees. Toe-in allows chip heads 52 and 54 to traverse flitch 14 without the need to actively skew the chip heads. Active edger 10 includes saw guides 56, which contact both sides of saws 46, 48 and 50 to provide stability to the saws as flitch 14 passes through the active edger.

Within active edger 10, saws 46, 48 and 50 are rotated by, and are translatable on splined saw arbor 53. Saw blades 50, 52 and 54, via saw guides 56 translates in direction C and skew in direction D.

Figure 8:
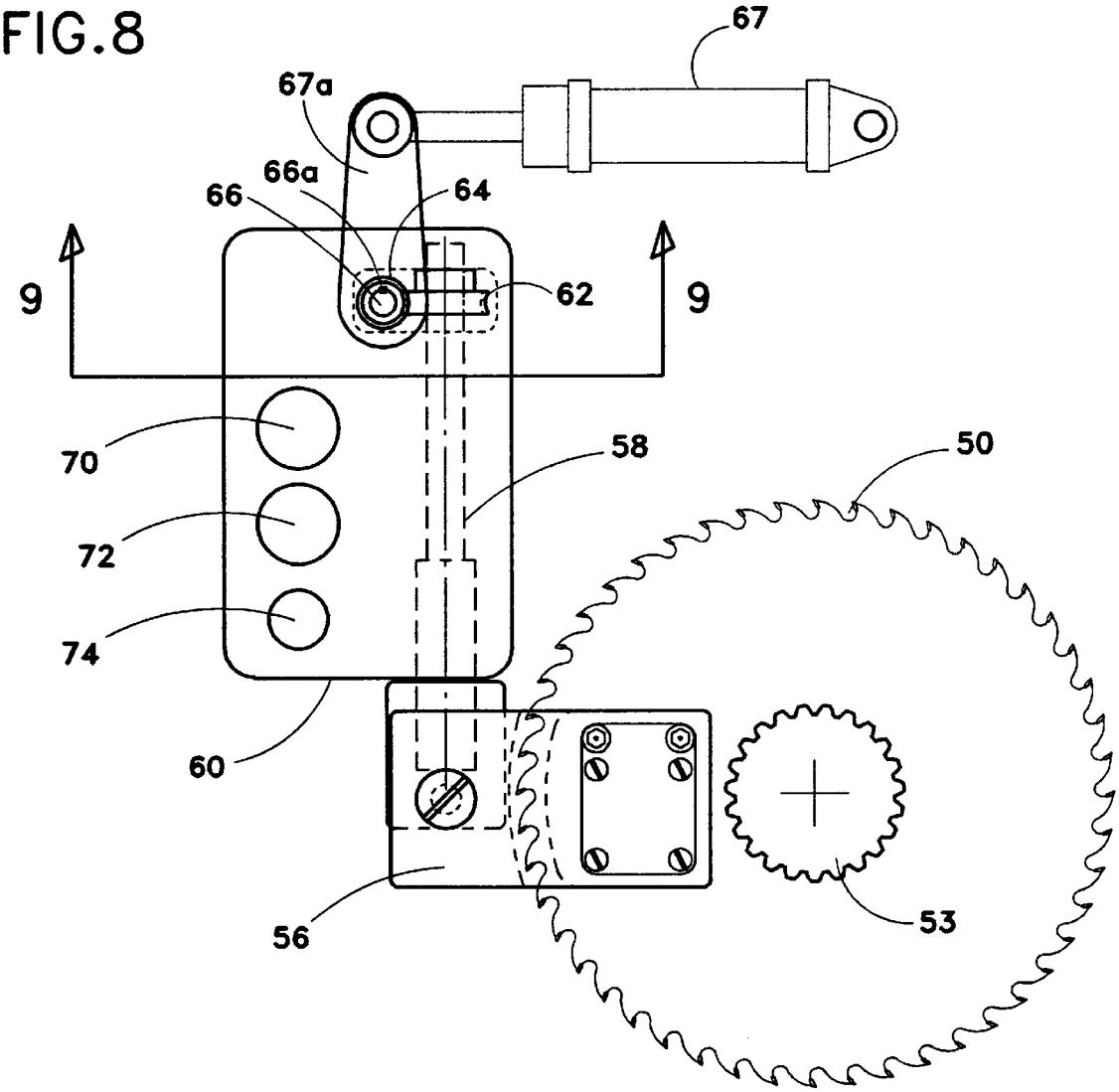
FIG. 8 is a enlarged view of the preferred embodiment of FIG. 6.
Figure 9:
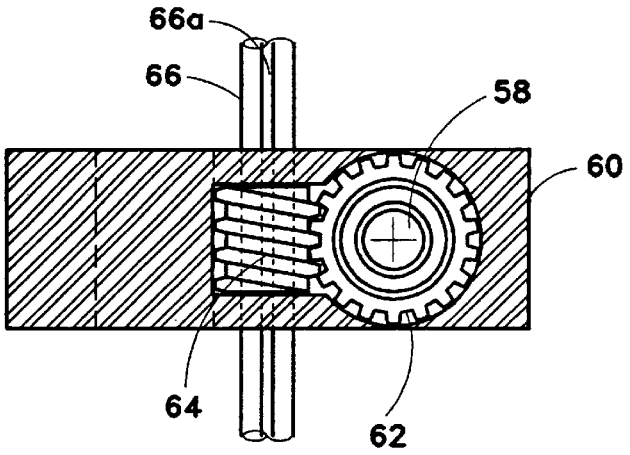
FIG. 9 is a section view along line 9—9 in FIG. 8, showing worm gears within the guide block.

As best seen in FIGS. 8 and 9, saw guides 56 are attached to, and skewed, by shaft 58, shown in dotted outline in FIG. 8, within saw guide block 60. Saw guide shaft 58 rotates saw guides 56, thus skewing saw guides 56 and saws 46, 48 and 50 to the correct angle, that is, corresponding to the skewed flitch 14. Worm gear 62 and corresponding worm 64 within saw guide blocks 60, mate shaft 58 to shaft 66 so that rotation of shaft 66 rotates shaft 58. Spine or keyway 66*a* allow worm 64 to slide on shaft 66, while rotating with shaft 66. Shaft 66 is rotated by Temposonic™ cylinder 67 (cylinder 67 may also be rotated by other means of precise controlled translation, such as stepper motors), through linkage 67*a*. Shaft 66 remotely actively skews the array of saw guides 56 corresponding to saws 46, 48 and 50 to follow the skew of fitch 14 as fitch 14 is translated through the saws. Saw guide blocks 60 are translated laterally by Temposonic™ cylinder shafts 70, 72 and 74 to first set saw spacing and then to actively translate saws 46, 48 and 50 with spacing set to the optimizer decision which corresponds to the skew of fitch 14, thereby allowing saws 46, 48 and 50 to actively traverse skewed fitch 14, or to gently curve edge fitch 14, as the case may be, (cylinder shafts 70, 72 and 74 may also be translated by other means of precise controlled translation, such as stepper motors).

Figure 3:
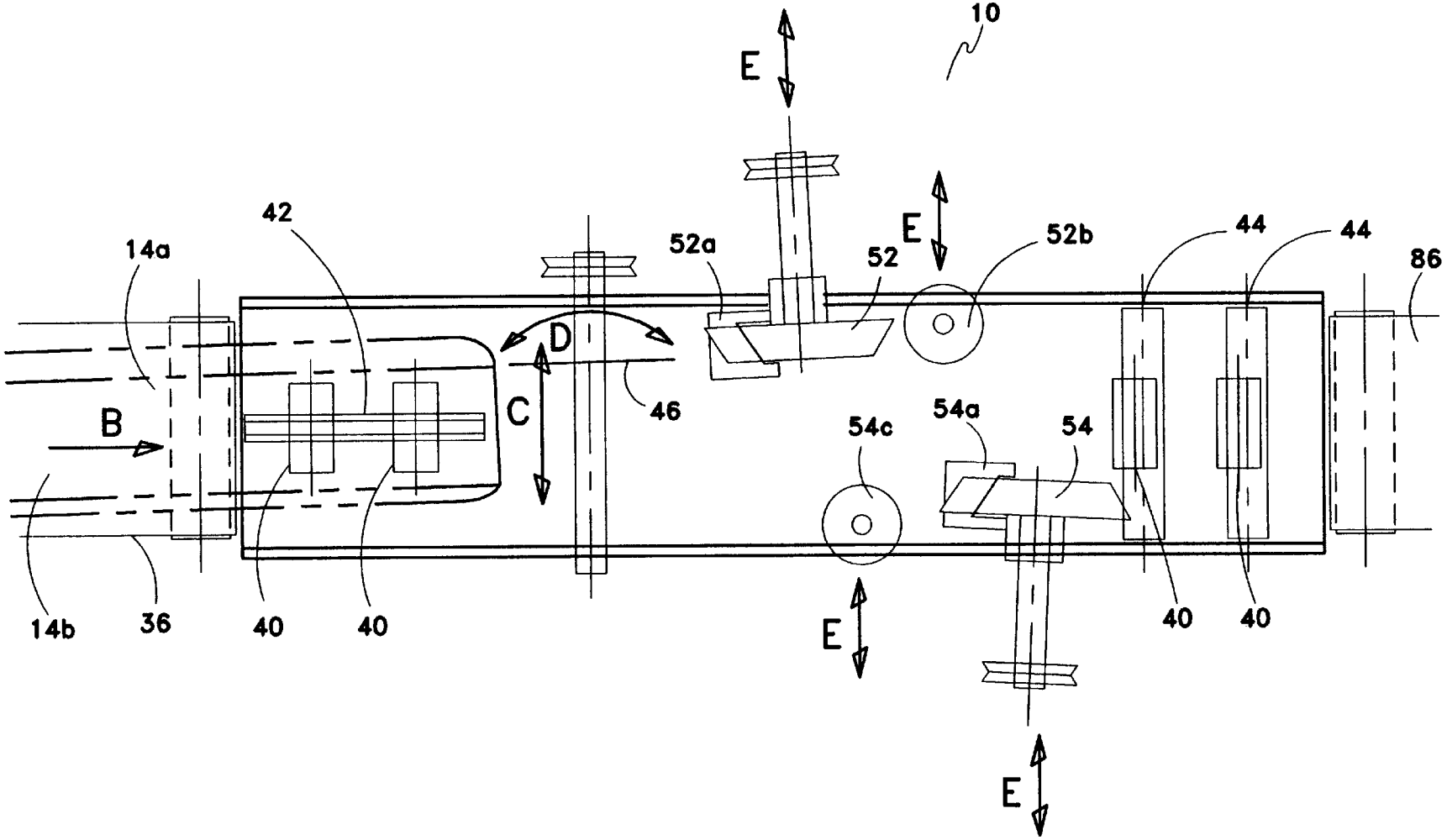
FIG. 3 is a plan view according to an alternative embodiment of the invention showing one saw blade and staggered chip heads.

In an alternate embodiment, as best seen in FIG. 3, active edger 10 has only one saw 46 on arbor 53, and chip heads 52 and 54 are staggered. As fitch 14 enters active edger 10, saw 46 and chip heads 52 and 54 translate into position in direction E, and continue to actively translate so as to follow the profile of fitch 14 as fitch 14 passes through active edger 10. Saw 46 saws the far side of fitch 14. Chip head 52 then chips the sawn edging as fitch 14 passes chip head 52. Side cushioned roller 52*b* adjusts to confirm the position of fitch 14. As fitch 14 passes chip head 52, the far side edge 14*a* is steadied by anvil roller 54*c*, which steadies fitch 14 as fitch 14 moves into chip head 54. Chip head 54 chips the near side edge 14*b* off fitch 14. This embodiment may be used in a single board solution, where only one board is produced from fitch 14.

Figure 13:
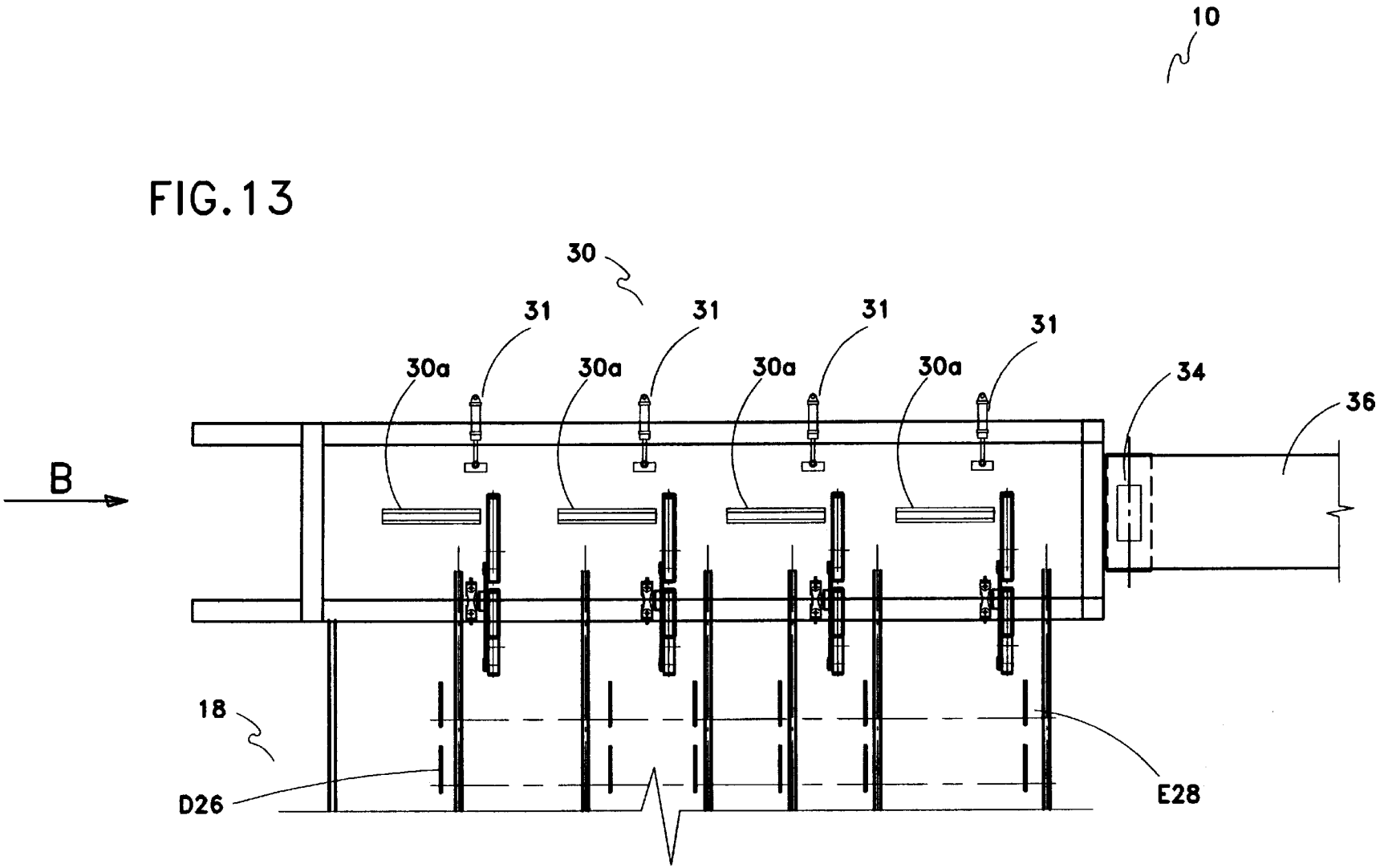
FIG. 13 is a plan view of an alternative feed table.

An alternative embodiment feed table 30 is shown in FIG. 13. Feed table 30 is used in conjunction with a transverse scanner (not shown), where fitch 14 is scanned as flitch 14 moves across transfer table 18 to feed table 30. A plurality of positioner cylinders 31 are provided to replace fence 32. The number of positioner cylinders depends on the lengths of flitches the system can process. Positioner cylinders 31 are in line with transverse scanner lasers (not shown) mounted to the transverse scanner, spaced apart in equally spaced transverse array, the transverse scanner mounted for example transversely across the transfer table. Positioner cylinders 31 may be set to position fitch 14 so that minimal movement of saws in edger 10 are needed. Positioner cylinders may extend a little after fitch 14 has been placed on feed table 30, thereby insuring the position of fitch 14 is known, even if the fitch has bounced. In this case, positioner cylinders 31 are set back the anticipated distance corresponding to the desired bounce correction, (fitch sizes may vary the extension of positioner cylinders from one system to another). Thus, fitch 14 may be positioned on the desired feed line on feed table 30.

Positioner cylinders 31 may be simple air cylinders that stroke out to ensure that the position of fitch 14 is known and accurate (as scanned). Alternately, positioner cylinders 31 may be Temposonic™ type cylinders, (or by other means of precise controlled translation, such as stepper motors). Temposonic™ type positioner cylinders 31 may be used to straighten a skewed fitch 14 to thereby reduce the need for edger 10 to skew. Temposonic™ type positioner cylinders 31 may be programmed to actively decelerate fitch 14, to thereby reduce edge crush, which causes a loss of recovery percentage, at the same time (i) allowing for increased speed of fitch placement on feed table 30 and, (ii) also thereby eliminating fitch bounce. Use of Temposonic™ cylinders may allow the manufacture of a single type of active edger, independent of the method of scanning (transverse of lineal) employed. This reduces the number of types of edgers, and thus reduces their cost.

Figure 4:
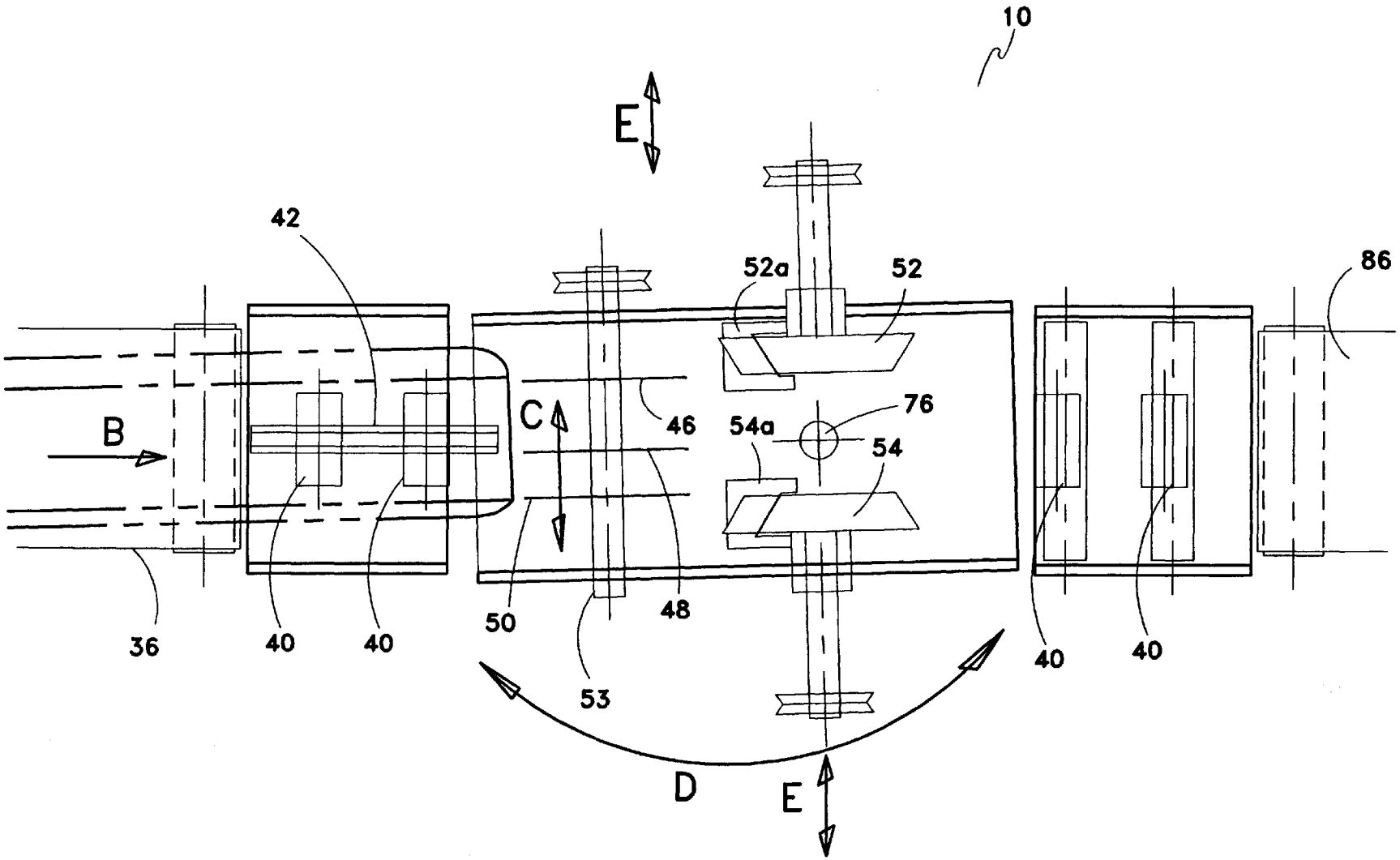
FIG. 4 is a plan view according to a further alternative embodiment of the invention, showing a translating and skewing saw box with two chip heads.
Figure 7:
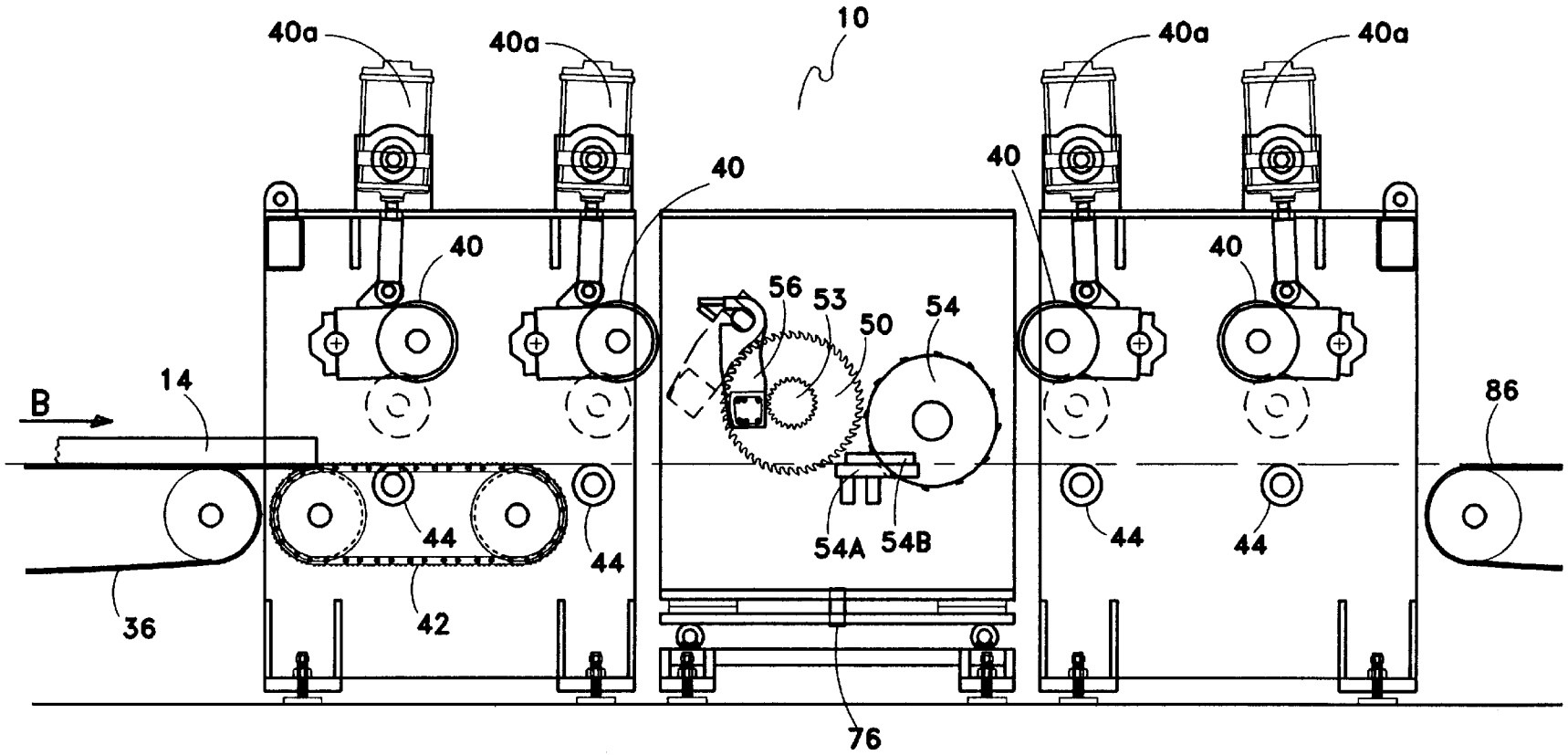
FIG. 7 is an elevation view according to an alternative embodiment of the invention.

In further alternative embodiment, as best seen in FIG. 4 and 7, active edger 10 skews in direction D on pivot axis 76. Active edger 10 skews in direction D and translates in direction E to position saw 46 and chip head 52 to begin edging a skewed flitch 14. The skew is then fixed. Concurrently, the spacing of saws 48 and 50 is set. The near side chip head 54 spacing is set along with near side saw 50. Thereafter, the active translation of active edger 10 in direction E follows the optimum line to edge the board as flitch 14 reaches saws 46, 48 and 50. Active skewing of edger 10 may be required for sawing a gentle curve when edging of a flitch is desired.

Figure 5:
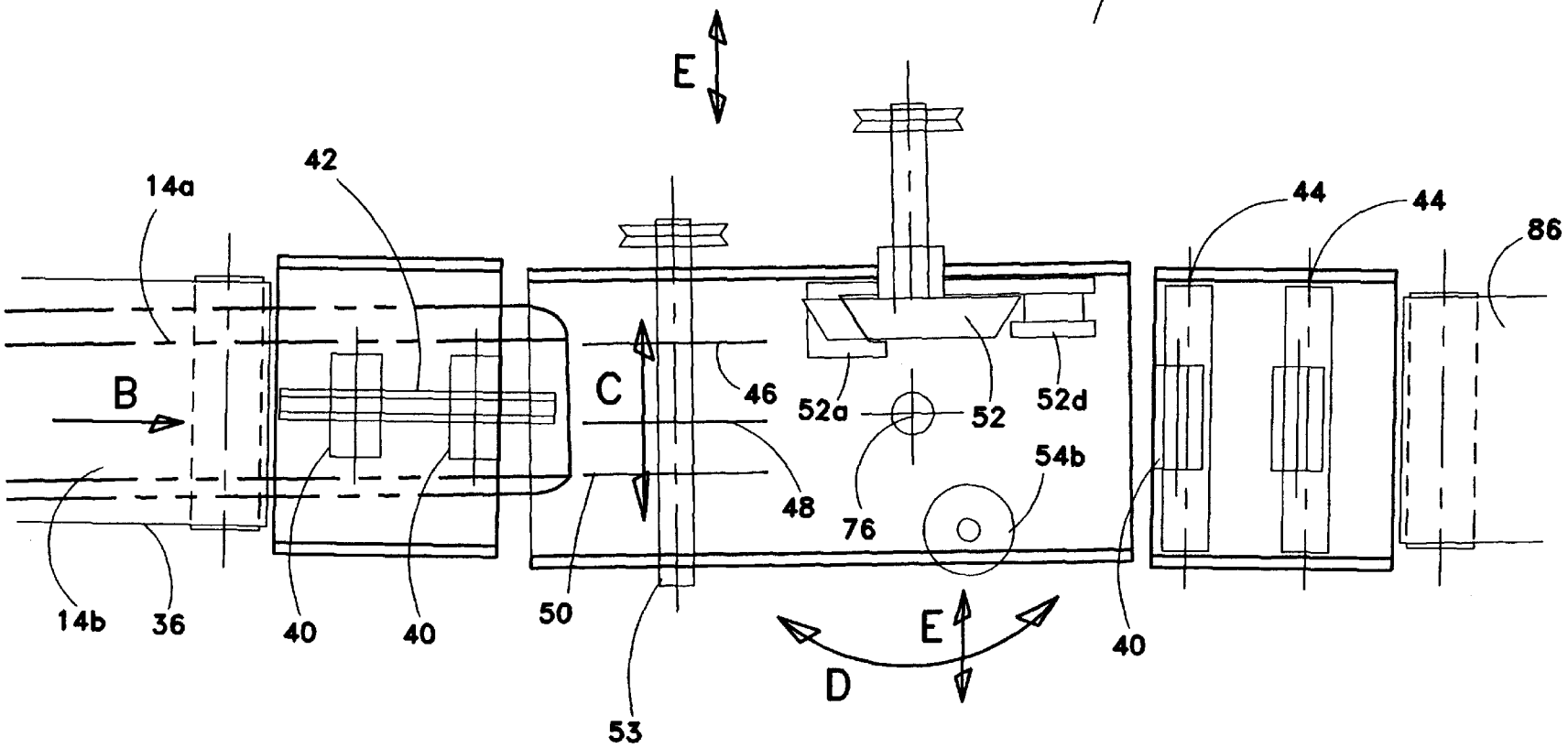
FIG. 5 is a plan view according to a further alternative embodiment of the invention, showing a translating and skewing saw box with one chip head.

In another embodiment as best seen in FIG. 5, active edger 10 skews in direction D on pivot axis 76. Active edger 10 skews in direction D and translates in direction E, positioning saw 46 and chip head 52 for edging the skew of flitch 14. The skew is fixed, the saw spacing of saws 48 and 50 set, and then only the translation of active edger 10 in direction E occurs to follow the optimum line to edge the board. The active skewing of edger 10 may be needed for sawing a gentle curve when edging of a flitch. In this embodiment only one chip head 52 is used and an adjustable cushioned roller 54*b* on the near side 14*b* may be employed. Roller 54*b* helps ensure the position of flitch 14, as flitch 14 is moved through edger 10 in direction B. Out feed anvil 52*d* may be provided on the far side edge 14*a*, which has just been sawn, further assisting to stabilize the position of flitch 14 as it moves through edger 10.

Figure 12:
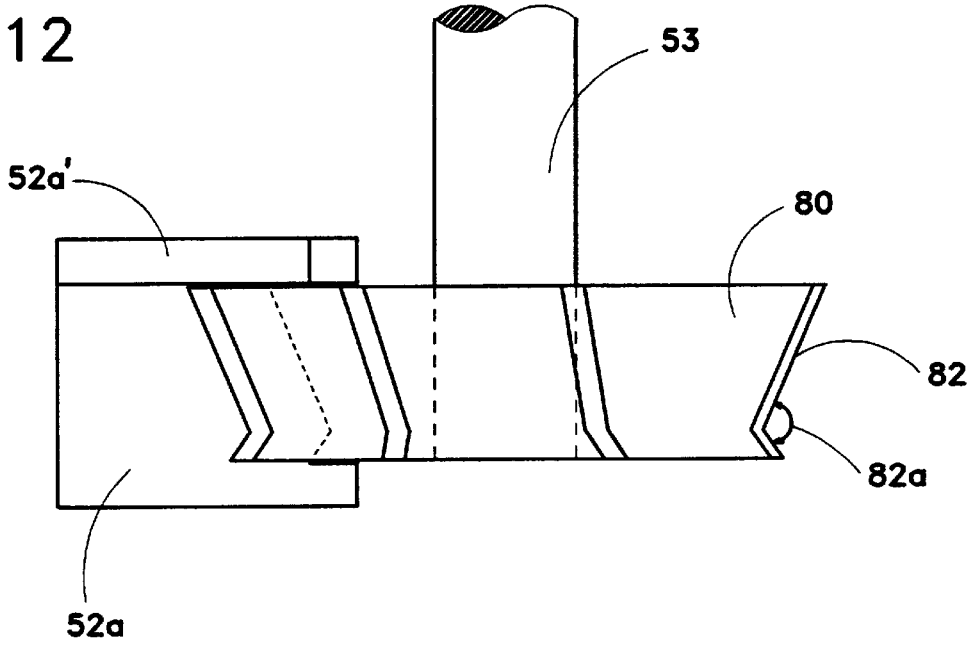
FIG. 12 is a plan view of an alternative chip head.
Figure 12A:
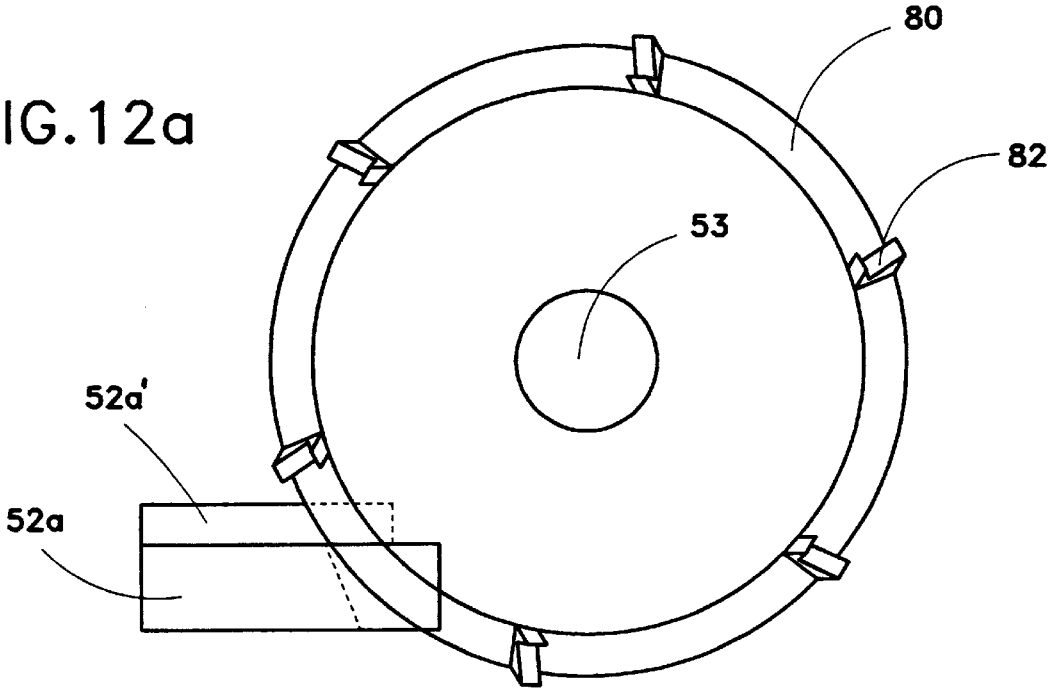
FIG. 12*a* is an elevation view of the alternative chip head of FIG. 12.

Referring again to the embodiment seen in FIG. 2, as flitch 14 moves through edger 10, the edgings (not shown), to be formed by the cutting away of waned edge slabs 14*c* and 14*d* by saws 46 and 50, are directed at chip heads 52 and 54 as the edgings move along with flitch 14 in direction B. Infeed anvils 52*a* and 54*a* assist in reducing the edgings created by saws 46 and 50 to chips, by directing edgings into chip heads 52 and 54. The chips created fall away on to a sawdust and chip conveyor (not shown). Driven pressrolls 40 continue pressing flitch 14 on to bed rolls 44 on the outfeed of edger 10. Pressrolls 40 are lifted, by actuation of cylinders 40*a*, as the trailing end of the flitch 14 passes through edger 10 onto outfeed belt 86. As shown in FIGS. 12 and 12*a*, anvil 52*a* may include side fence 52*a'* to redirect any loose edgings back into chipping head 52. Loose edgings may otherwise move off to the side, away from chipping head 52. Similarly, anvil 54 may include a side fence (not shown).

FIGS. 12 and 12*a* also illustrate an improved chip head 80 having V-shaped wing knives 82. V-shaped wing knives 82 direct the edgings into the mid portion of chip head 80, to inhibit slivers from being forced between the chip head and sawn edge of flitch 14. The illustrated angle 82*a* of V-shaped wing knives 82 is not to scale, although angle 82*a* should have a defined angle akin to the angle shown. The rest of the chip head may be a cone or drum-like.

Figure 10:
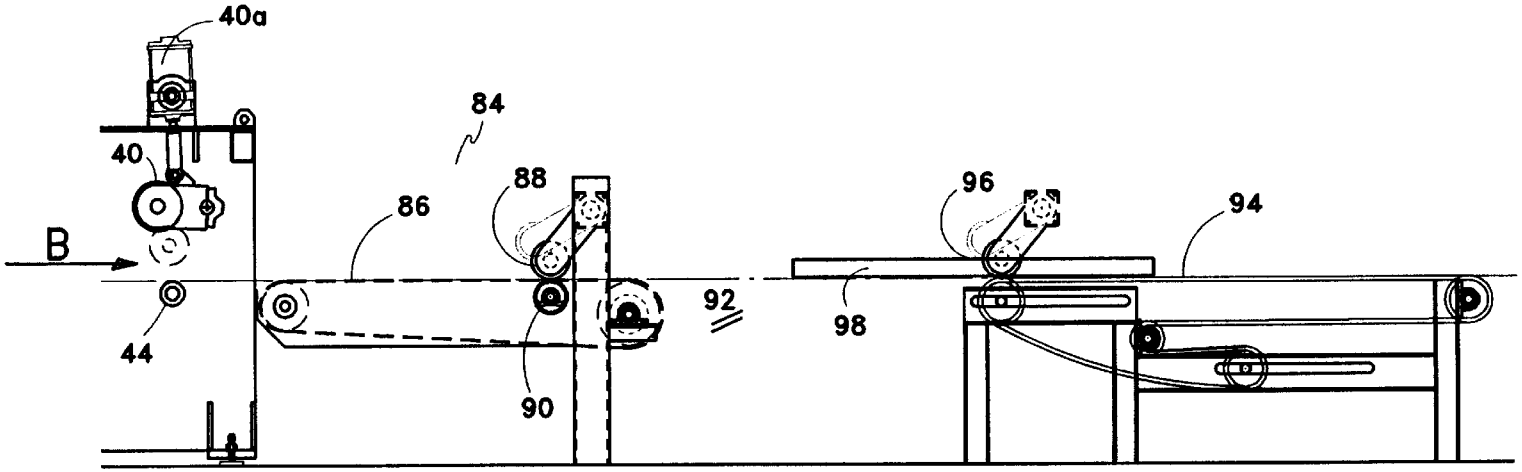
FIG. 10 is an elevation view of the simplified tailer.
Figure 11:
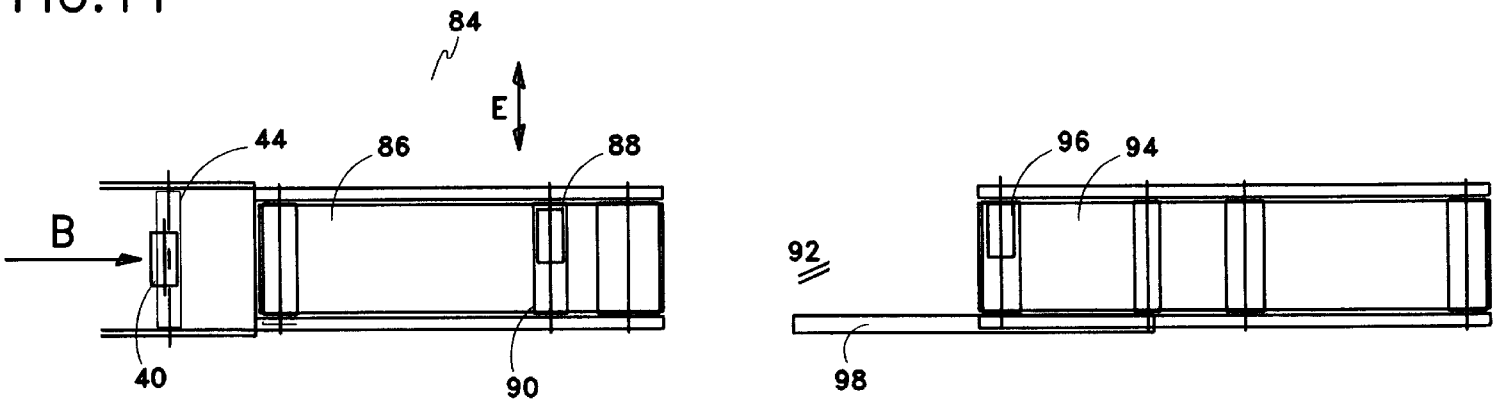
FIG. 11 is a plan view of the simplified tailer of FIG. 10.

A simplified tailer 84 is seen in FIGS. 10 and 11. Tailer 84 works in conjunction with the above embodiments when only one chip head 52 is used on the far side 14*a*. Tailer 84 cooperates with edger outfeed belt 86. Edger outfeed belt 86 has an overhead press roll 88 adjacent its downstream end, downstream in the direction of flow, direction B. Pressroll 88 holds flitch 14 (now a board, or boards) down on to belt 86. Roller 90 under belt 86 prevents the action of overhead press roll 88 pressing on flitch 14 from slowing outfeed belt 86. Overhead press roll 88 cantilevers flitch 14 over a gap 92. The near side edging of flitch 14 falls through gap 92 onto a conveyor (not shown). Because of the shape of the edgings and because that they are not supported by the overhead press roll 88, the edgings simply fall off to the side of flitch 14. Overhead press roll 88 may be adjustable in direction E depending on mill requisites. Depending on how long and how wide the boards coming out of the edger are, and what their skew maximum is, dictates whether there is a need for a side to side adjustment of overhead press roll 88. Secondary outfeed belt 94 cooperates with a secondary outfeed hold down means such as pressroll 96. Secondary outfeed hold down 96 supports board(s) as they are moving over gap 92. Near side fence 98 redirects board(s) back into the direction of flow, direction B. Near side fence 98 is needed when the lengths of flitch 14, in combination with flitch 14 skew maximums, cause board(s) to move off track. Secondary outfeed belt 94 can be an adjustable belt, adjustable in direction E or direction B if needed, again depending on mill requisites, where lengths and skew maximums require greater machine flexabilities.

Figure 14:
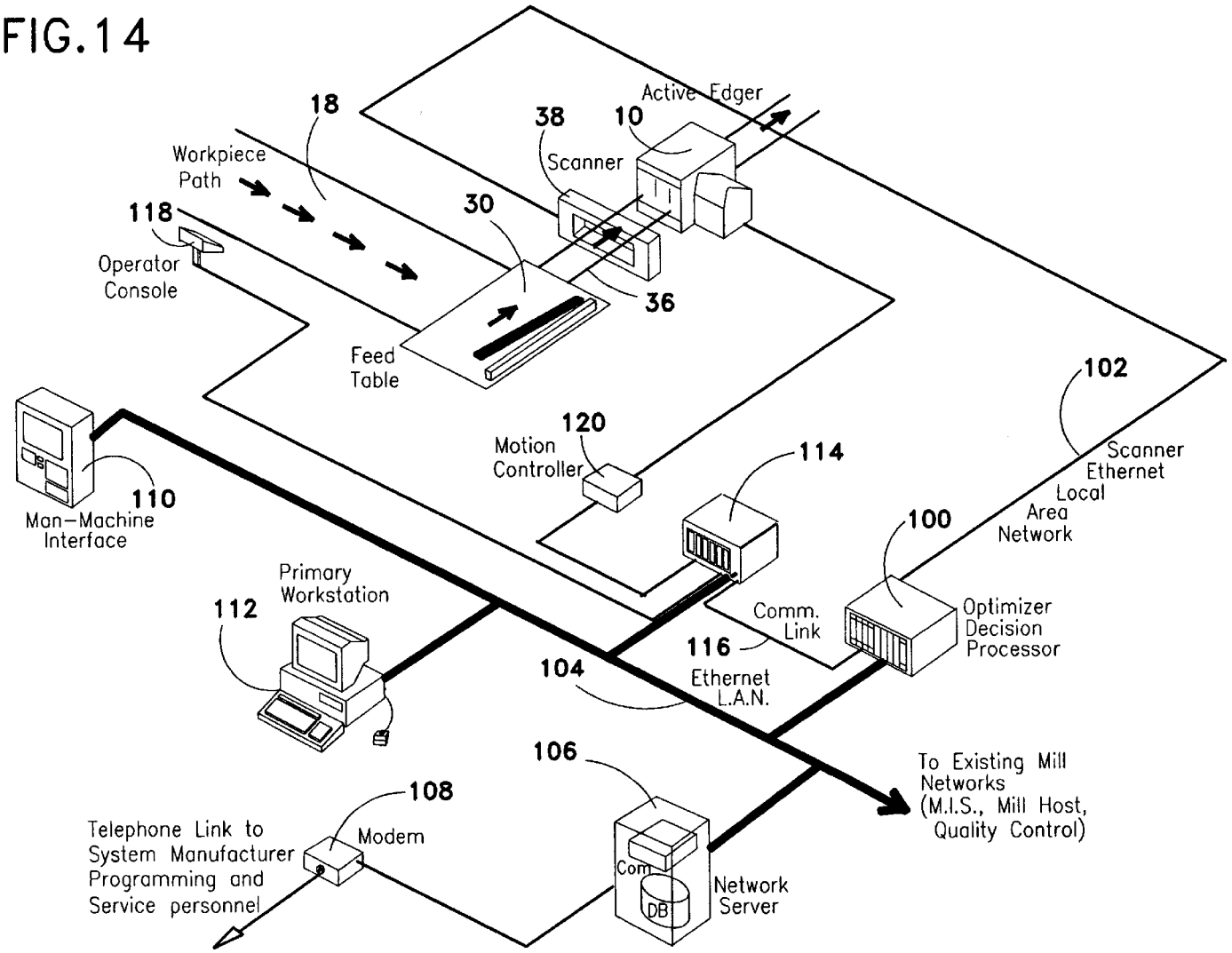
FIG. 14 is, in perspective view, a block schematic diagram showing the relationship of the electronic devices.

As best seen in FIG. 14, an optimizer decision processor 100 and the scanner 38 communicate on a common scanner local area network 102. There is an ethernet local area network (LAN) 104 and a network server 106 for network communications, and a modem 108 for external communications. The man-machine interface 110 and primary workstation 112 also communicate over the ethernet LAN 104.

The optimizer decision processor 100 and associated network server 106, man-machine interface 110, programmable logic controller (PLC) 114 and primary work station 112 communicate across a common ethernet LAN 104 which is available as a connection point to existing mill networks. This connection point allows workstations within the existing mill offices (with appropriate software) access to all fitch optimization functions. A dedicated communications link 116 may exist between the optimizer decision processor 100 and the programmable logic controller (PLC) 114. All workstations and the network server 106 contain applications which provide mill personnel the tools they require to define their environment (scanner, optimizer, machine center, products, shift schedules, reports) to the fitch optimizer system; pre-generate various start-up configurations; start, stop and load the system; visually monitor the fitch 14 as it proceeds through the machine centers and monitor the operation for unusual conditions. The operators console 118 allows the operator to stop the movement of flitches 14 or divert a fitch through dropout 19.

Modem 108 attached to the network server 106 and the primary workstation 112 using remote access software and appropriate controls, allows remote dial-up access to the mill site for software reprogramming and remote operation of almost every application and function as well as retrieval of statistics and flitch summaries for off-site service analysis. The man-machine interface 110 provides operator input and allows the operator access to various levels of machine operation and control. The PLC 114 and motion controllers 120, share the task of monitoring speed and position of the fitch 14 and controlling positioners. Encoders (not shown) on belt 36, provide tracking information relative to the movement of the flitch 14.

It is apparent then that variations and modifications of the invention can be made without departing from the spirit or scope thereof. Such variations might include, zero near side positioning, which would essentially apply the same rules as "zero far side" positioning, except the action of the feeding table 30 would be slightly different than that depicted herein. Such variations and modifications are meant to be comprehended within the scope of the invention.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An active edger comprising:

a gangsaw mounted on an arbor, said gangsaw and said arbor mounted within a stationary saw box, said gangsaw actively positionable on said arbor relative to said saw box, said gangsaw for sawing a workpiece conveyed longitudinally in a downstream direction along a flow path into said gangsaw, said gangsaw including a first end saw for sawing a first edging from said workpiece according to an optimized cutting solution, a first chipping head mounted to a first side of said saw box, said first chipping head mounted downstream of said first end saw and aligned so as to chip said first edging,said first chipping head actively laterally positionable in unison with said first end saw.

2. The active edger of claim 1 further comprising a second actively laterally positionable chipping head mounted to a second side of said saw box, opposite to said first side of said saw box.

3. The active edger of claim 2 wherein said second chipping head is downstream of a second end saw in said gangsaw, and wherein said second chipping head is actively laterally positionable so as to:

(a) actively align with a second feed line corresponding to said second end saw; and, (b) be actively laterally positionable in unison with said second end saw.

4. The active edger of claim 3 wherein said second chipping head is adjacent said second end saw and mounted in opposed facing relation to said first chipping head.

5. The active edger of claim 2 wherein said second chipping head is staggered, relative to said first chipping head, in said downstream direction.

6. The active edger of claim 4 wherein said first and second chipping heads are toed-in relative to said first and second end saws respectively.

7. The active edger of claim 5 wherein said first and second chipping heads are toed-in relative to said first and second end saws.

8. An active edger comprising:

a gangsaw mounted on an arbor, said gangsaw and said arbor mounted within an actively positionable saw box, said gangsaw for sawing a workpiece conveyed longitudinally in a downstream direction along a flow path into said gangsaw, said saw box actively positionable by selective lateral translation of said saw box and selective skewing of said saw box about a pivot axis perpendicular to said flow path, said gangsaw including a first end saw for sawing a first edging from said workpiece according to an optimized cutting solution, a first chipping head mounted to a first side of said saw box, said first chipping head mounted downstream of said first end saw and aligned so as to chip said first edging, said first chipping head actively laterally positionable in unison with said first end saw.

9. The active edger of claim 8 further comprising a second actively laterally positionable chipping head mounted to a second side of said box, opposite to said first side of said saw box.

10. The active edger of claim 9 wherein said second chipping head is downstream of a second end saw in said gangsaw, mounted on said arbor, actively laterally positionable so as to:

(a) actively align with a second feed line corresponding to said second end saw; and, (b) be actively laterally positionable in unison with said second end saw.

11. The active edger of claim 10 wherein said second chipping head is adjacent said second end saw and mounted in opposed facing relation to said first chipping head.

12. The active edger of claim 9 wherein said second chipping head is staggered, relative to said first chipping head, in said downstream direction.

13. The active edger of claim 1 wherein said gangsaw is actively positionable by selective lateral translation of said saw box and selective skewing of said gangsaw relative to said saw box about a pivot axis perpendicular to said flow path, and wherein saw guides corresponding to saws within said gangsaw are selectively rotatable about corresponding vertical axes of rotation whereby rotating said guides skews said saws.

14. The active edger of claim 13 wherein said saw guides are mounted on corresponding shafts and said shafts are selectively rotatable by selective rotation means for selectively rotating said shafts so as to thereby rotate said saw guides whereby saws mounted between said saw guides are skewed relative to said arbor.

15. The active edger of claim 14 wherein said selective rotation means are actuator driven worms and mating worm gears for selective rotation of said shafts.

16. The active edger of claim 1 or 8 wherein said first chipping head comprises V-shaped chipping head knives mounted thereon.

17. The active edger of claim 1 or 8 further comprising an anvil cooperating with said first chipping head so as to direct said first edging into said first chipping head.

18. The active edger of claim 17 wherein said anvil further comprises a side fence mounted laterally outward on said anvil so as to register with said first edging whereby said first edging is forced back into said first chipping head.

19. An active edger comprising:

a first end saw mounted on an arbor, said first end saw and said arbor mounted within a stationary saw box, said first end saw actively positionable on said arbor relative to said saw box, said first end saw for sawing a workpiece conveyed longitudinally in a downstream direction along a flow path into said first end saw, said first end saw for sawing a first edging from said workpiece according to an optimized cutting solution, a first chipping head mounted to a first side of said saw box, said first chipping head mounted downstream of first end saw and aligned so as to chip said first edging, said first chipping head actively laterally positionable in unison with said first end saw.

20. The active edger of claim 19 further comprising a second actively laterally positionable chipping head mounted to a second side of said saw box, opposite to said first side of said saw box.

21. The active edger of claim 20 wherein said second chipping head is downstream of a second end saw in said gangsaw, and wherein said second chipping head is actively laterally positionable so as to:

(a) actively align with a second feed line corresponding to said second end saw; and, (b) be actively laterally positionable in unison with said second end saw.

22. The active edger of claim 21 wherein said second chipping head is adjacent said second end saw and mounted in opposed facing relation to said first chipping head.

23. The active edger of claim 20 wherein said second chipping head is staggered, relative to said first chipping head, in said downstream direction.

24. The active edger of claim 22 wherein said first and second chipping heads are toed-in relative to said first and second end saws.

25. The active edger of claim 23 wherein said first and second chipping heads are toed-in relative to said first and second end saws.

26. An active edger comprising:

a first end saw mounted on an arbor, said first end saw and said arbor mounted within an actively positionable saw box, said first end saw for sawing a workpiece conveyed longitudinally in a downstream direction along a flow path into said first end saw, said saw box actively positionable by selective lateral translation of said saw box and selective skewing of said sawbox about a pivot axis perpendicular to said flow path, said gangsaw including a first end saw for sawing a first edging from said workpiece according to an optimized cutting solution, a first chipping head mounted to a first side of said saw box, said first chipping head mounted downstream of said first end saw and aligned so as to chip said first edging, said first chipping head actively laterally positionable in unison with said first end saw.

27. The active edger of claim 26 further comprising a second actively laterally positionable chipping head mounted to a second side of said saw box, opposite to said first side of said saw box.

28. The active edger of claim 27 wherein said second chipping head is downstream of a second end saw in said gangsaw, mounted on said arbor, actively laterally positionable so as to:

(a) actively align with a second feed line corresponding to said second end saw; and, (b) be actively laterally positionable in unison with said second end saw.

29. The active edger of claim 28 wherein said second chipping head is adjacent said second end saw and mounted in opposed facing relation to said first chipping head.

30. The active edger of claim 27 wherein said second chipping head is staggered, relative to said first chipping head, in said downstream direction.

31. The active edger of claim 19 wherein said first end saw is actively positionable by selective lateral translation of said first end saw and selective skewing of said first end saw relative to said saw box about a pivot axis perpendicular to said flow path, and wherein saw guides corresponding to said first end saw are selectively rotatable about corresponding vertical axes of rotation whereby rotating said guides skews said first end saw.

32. The active edger of claim 31 wherein said saw guides are mounted on corresponding shafts and said shafts are selectively rotatable by selective rotation means for selectively rotating said shafts so as to thereby rotate said saw guides whereby saws mounted between said saw guides are skewed relative to said arbor.

33. The active edger of claim 32 wherein said selective rotation means are actuator driven worms and mating worm gears for selective rotation of said shafts.

34. The active edger of claim 19 or 26 wherein said first chipping head comprises V-shaped chipping head knives mounted thereon.

35. The active edger of claim 19 or 26 further comprising an anvil cooperating with said first chipping head so as to direct said first edging into said chipping head.

36. The active edger of claim 35 wherein said anvil further comprises a side fence mounted laterally outward on said anvil so as to register with said first edging whereby said first edging is forced back into said first chipping head.

37. The active edger of claim 1, 8, 19 or 26 further comprising means for cantilevering said workpiece over a gap in a workpiece conveyor, said gap downstream of said saw box, said cantilever means for cantilevered supporting of said, workpiece but not said first edging whereby said first edging may fall into said gap as said workpiece is conveyed over said workpiece conveyor.

* * * * *